United States Patent [19]

Dwyer

[11] Patent Number: 4,474,378

[45] Date of Patent: Oct. 2, 1984

[54] GOLF CLUB SWING DEVELOPMENT DEVICE

[76] Inventor: John E. Dwyer, 2600 S. Kanner Hwy., Apt. D-7, Stuart, Fla. 33497

[21] Appl. No.: 480,269

[22] Filed: Mar. 30, 1983

[51] Int. Cl.[3] ..... A63B 69/36; A63B 21/04

[52] U.S. Cl. ..... 273/186 C; 273/187 R; 273/193 A; 273/189 R; 272/138; 272/DIG. 5

[58] Field of Search ..... 272/124, 125, 141, 126, 272/134, 135, 136, 137, 138, 139, 142, DIG. 5; 273/186 C, 191 B, 193 A, 193 B, 186 R, 186 A, 189 R

[56] References Cited

U.S. PATENT DOCUMENTS

| | | | |
|---|---|---|---|
| 1,137,349 | 4/1915 | Patterson | 272/140 |
| 2,848,234 | 8/1958 | Brandon | 273/191 B |
| 2,858,133 | 10/1958 | Self | 273/186 R |
| 3,083,016 | 3/1963 | Sumegi | 273/191 B |
| 3,246,898 | 4/1966 | Shoaf | 273/186 C |
| 3,415,524 | 12/1968 | Vickers | 273/189 R |
| 3,561,758 | 2/1971 | Huber | 272/138 X |
| 3,618,942 | 11/1971 | Bates | 272/136 |
| 3,747,925 | 7/1973 | Seeger | 272/140 |
| 4,328,964 | 5/1982 | Walls | 272/136 |

*Primary Examiner*—George J. Marlo

*Attorney, Agent, or Firm*—Kalish & Gilster

[57] ABSTRACT

A golfer's exerciser of the isometric type includes a golf club-simulative member having a shaft grippable at its upper end in the manner of a golf club. The grip-remote end of said club-simulative member is pivotally affixed at a position in front of the user for presenting the shaft in an orientation simulative of the position of a golf club at the moment of impact of the golf club with a ball. A dynamic indicator provides resilient interconnection of said grip-remote end with an affixing structure dynamically, resiliently resisting movement of the grip-remote end laterally away from an initial position defined by the affixing structure, permitting such movement from the initial position only upon user development of a predetermined minimum dynamic force of ball-striking character, with such movement providing the user with dynamic indication of a ball-striking force exerted by the user on magnitude sufficient for development of the user's musculature. The device has a platform of generally rectangular configuration. An elongated guide member extends forwardly from the platform between the user's feet, the affixing structure having a fixture slidable along the elongated guide member to a selected portion in front of the user.

6 Claims, 5 Drawing Figures

FIG. 3
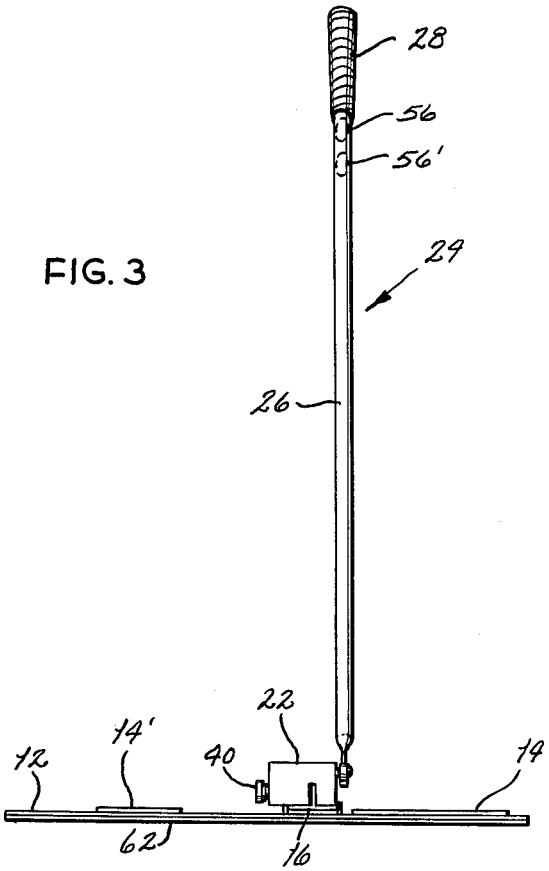
FIG. 4
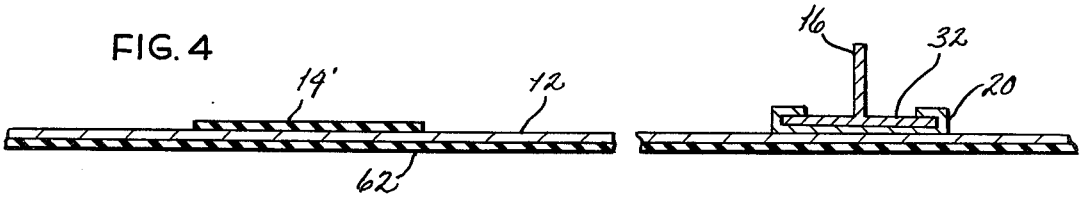
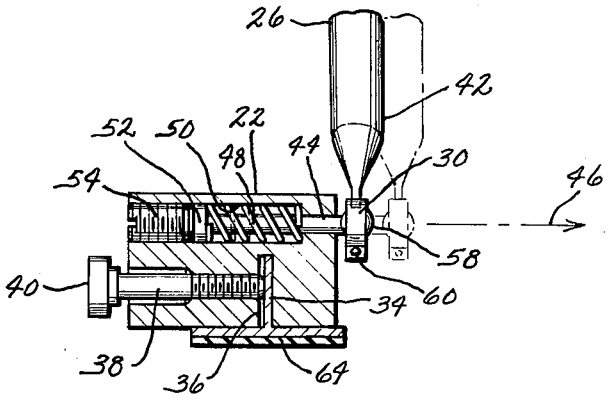
FIG. 5

GOLF CLUB SWING DEVELOPMENT DEVICE

BACKGROUND AND SUMMARY OF THE INVENTION

This invention relates to exercising apparatus of the isometric type and, more particularly, to a golfer's exerciser for producing isometric development of the muscles used in the golf swing.

Golfers typically have limited opportunities for developing the musculature used during the golf swing. During the winter months, when outside activities are restricted, inactivity or inability to exercise produces a weakening in the arm and shoulder muscles and other muscles which come into play during the golf swing, resulting in decreased ball striking force and slower swing of the golf club than desired for long, straight, accurate drives. Therefore, golfers have a continual need to develop and increase the strength of those muscles which are utilized during the actual swing of the club and particularly at the moment of impact with the ball.

Isometric exercise is a well known technique for improving the strength of muscles. But apparatus particularly intended for and truly useful for golfers' development of the particular muscles used during the golf swing and striking of the ball has not be available. Such exercising equipment as has existed has been inefficient and generally unsuited for attaining efficient strengthening of the particular musculature utilized by a golfer.

A golf swing-conditioner disclosed in U.S. Pat. No. 2,848,234 allows a golfer to use a club-simulative handle to stretch a cord as the handle is moved through portions of the golf swing. However, this arrangement does not allow a precise application of isometric force by the golfer at the point of impact with the ball, there being no way of determining in fact when the handle is at a position corresponding to its proper position at the time actually corresponding to the striking of a ball. Moreover, the user is severely limited by the elastic nature of the cord and thus cannot develop greater isometric force than determined by its elastic properties. Another problem is that one end of the cord must be tethered to extrinsic structure.

A golf indoor practice device disclosed in U.S. Pat. No. 3,083,016 also suffers from similar disadvantages. This device, which has a handle tied to a long, stretchy spring having one end connected to a platform, is possibly detrimental to muscle development in that, once the golfer has moved the club-simulative handle past some vaguely-defined center position to begin a swing, the spring tends to return the handle so that one exerts muscle force in the direction opposite from that needed during the swing. Other exercising devices are disclosed in U.S. Pat. Nos. 3,561,758; 3,747,925; and 4,328,964 but these, too, fail to provide isometric development of those muscles especially needed during the golfer's swing at the moment of impact with the ball.

None of such prior art apparatus provides to the user an accurate dynamic indication of the development of a level of isometric force which is needed to be able to assure the user of developing the required musculature, particularly noting that isometric exercise is of little value unless a requisite minimum force can be developed which will cause actual stimulation and growth of muscle tissue.

It is an object of the present invention to provide an improved exerciser of the isometric type, and particularly useful by a golfer for developing the musculature utilized during the golfer's swing, and especially at the point of impact with the ball.

It is also an object of the present invention to provide such an improved exerciser which precisely orients a golf club-simulative member for being grasped by the user in the precise orientation which prevails at the exact point of impact of the golf club when striking a ball, as well as indicating to the golfer proper placement of the feet for promoting the desired stance at the time the club strikes the ball and thereby achieving not only improved strength but also conditioning the golfer, through habit and practice, to utilize proper stance and positioning of the muscles.

Another object of the invention is the provision of such an exerciser which will provide to the golfer a dynamic, realistic indication of the application of the requisite minimum isometric force for stimulating and causing growth of the musculature needed for efficient, powerful swinging of the club, as well as providing the user with the ability to adjust the exerciser to preselect such minimum force so that indication will be given only upon exceeding the preselected minimum.

A further object of the invention is the provision of such an exerciser which is adjustable according to the personal measurements and preferences of a golfer; which is of compact, easily stored character; and which can be disassembled and compactly packaged for shipment or the like.

Briefly, the new golfer's exerciser of the isometric type includes a golf club-simulative member having a shaft grippable at its upper end in the manner of a golf club. The grip-remote end of said club-simulative member is pivotally affixed at a precise position in front of the user for presenting the shaft in an orientation simulative of the position of a golf club at the moment of impact of the golf club with a ball. An elongated guide member extends forwardly from the platform between the user's feet, the affixing structure having a fixture slidable along the elongated guide member to a selected position in front of the user. A dynamic indicator carried by the fixture provides resilient interconnection of said grip-remote end with an affixing structure for dynamically resisting movement of the grip-remote end laterally away from an initial position defined by the affixing structure, but permitting such movement from the initial position only upon user development of a predetermined minimum dynamic force of ball-striking character, as determined by a coil spring, the tension of which has been preset by the user. Such movement thus provides the user with dynamic indication of a ball-striking force exerted by the user of magnitude sufficient for development of the user's musculature.

Other object and features will be in part apparent and in part pointed out hereinbelow.

BRIEF DESCRIPTION OF THE DRAWINGS

FIG. 3 is a front elevational view thereof.

FIG. 4 is an enlarged transverse cross-sectional view taken generally along line 4—4 of FIG. 2.

FIG. 5 is an enlarged cross-sectional view, particularly showing an attachment fixture of the exerciser, taken generally along line 5—5 of FIG. 1.

Corresponding reference characters indicate corresponding parts throughout the several views of the drawings.

DESCRIPTION OF THE PREFERRED EMBODIMENT

Figure 1:
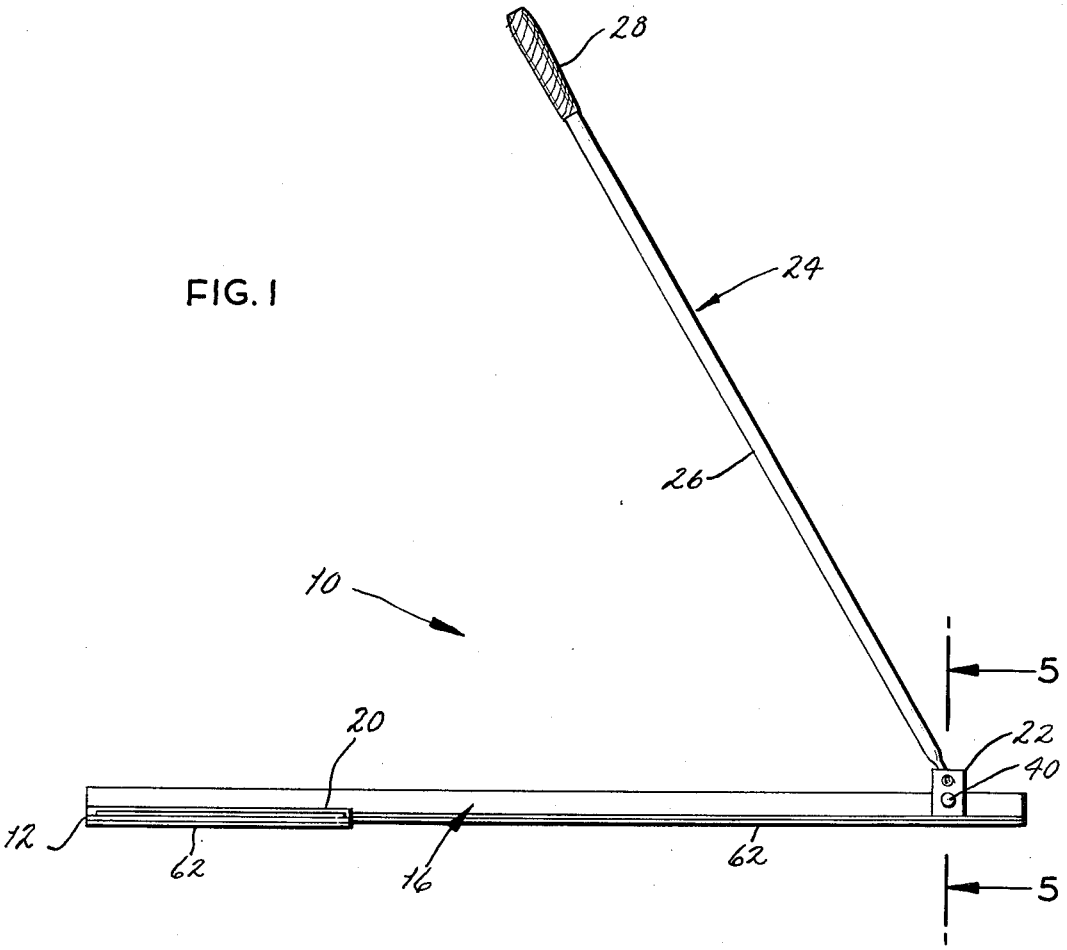
FIG. 1 is a side elevation view of a new golfer's exerciser of the isometric type constructed in accordance with and embodying the present invention.
Figure 2:
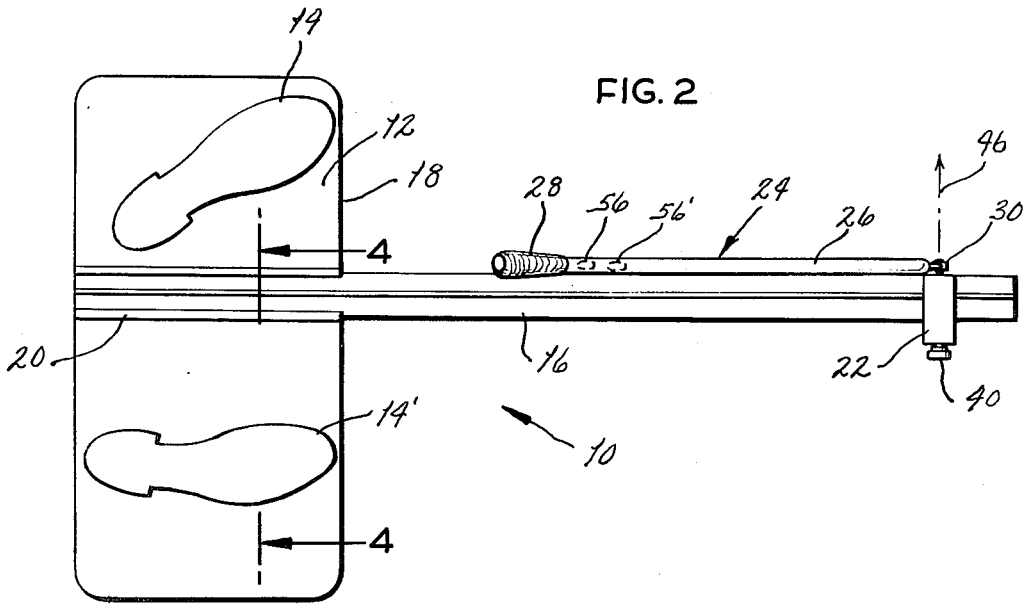
FIG. 2 is a top plan view of the exerciser.

Referring now the the drawings by reference characters, the new exerciser is designated generally at 10 and includes a platform 12 of generally rectangular configuration upon which the user may stand according to two foot placement position indicia such as a shoe outline 14 for the left foot and another outline 14' for the right foot. An elongated member 16 extends forwardly of platform 12 in perpendicular relationship to the forward edge 18 of platform 12, being received slidingly within a flanged channel 20 which is suitably secured to the upper surface of the platform across its depth from front to rear for rigid interengagement of platform 12 with elongated member 16. The foot placement indicia or outlines 14, 14' may most preferrably take the form of thin pads of rubber or other resilient material and are precisely located, relative to the longitudinal center line of member 16 for optimum placement of the feet according to the preferred stance for a golfer, such center line defining an axis which would extend through an assumed ball to be struck by the golfer.

Pivotally affixed by an attachment fixture 22, at a location toward the platform-remote end of member 16, is a golf club-simulative member generally 24 having a shaft 26 including a grip 28 at its distal end to be grasped by the user in the manner of a golf club. The grip-remote end of member 26 includes a fitting 30 which, as explained more fully below, permits pivotal movement of the grip-remote end of member 24, relative to fixture 22, in multiple degrees of freedom.

Referring to FIG. 4, member 16 is of T-section material, such as extruded aluminum, to provide a base flange 32, which is received by channel 20, and a vertical flange 34 which is receivable by a vertical slot 36 of fixture 22. Thus, member 16 serves as a guide for fixture 22, which may be moved along the length of member 16 to a desired location to accommodate the personal preferences of the golfer as well as to allow for different heights and other personal measurements of a golfer and whereby fixture 22 may be located at a precise distance in front of the golfer corresponding to the position which would be occupied by a ball if the club-simulative member 24 were actually a golf club. A set screw 38 is threaded into the metal body of fixture 22 for being clamped against the corresponding face of vertical flange 34 by tightening of its head 40. In this way, an adjustable clamp arrangement or means is provided for permitting selective clamping of attachment fixture 22 at a predetermined location along the length of the elongated guide member 16 dependent upon the personal preference and measurements of the user.

A resilient interconnection of the grip-remote end 42 of shaft 26 with fixture 22 is achieved by the use of a plunger 44 reciprocal laterally in and out of the body of fixture 22 along an axis 46 aligned with the normal direction of ball movement which would result when struck by a golf club. A coiled compression spring 48 is held captive upon plunger 44 within a bore 50 of fixture 22 for biasing a head 52 of plunger 44 toward a position within the attachment fixture and opposite from the normal direction of ball movement which is represented by axis 46. Thus, spring 48 resiliently biases plunger 44 inwardly, relative to the body of fixture 22. An adjustment screw 54 is threaded into the outer end of bore 50 for abutment against head 52 to permit selective adjustment of the tension of coil spring 48 by permitting it to be relatively more or less compressed so that, if tightly compressed, for example, spring 48 will be more resistant to the outward movement of plunger 44.

This arrangement provides a dynamic force indicator for the user who, when standing upon the foot placement indicia 14, 14' and grasping grip 28 with both hands, will endeavor to move the grip-remote end 42 in the direction of axis 46. Thus the user will attempt isometrically to cause plunger 44 to move outwardly from the body of fixture 22 against the resistance of spring 48. This will require considerable effort on the part of the user because of the relative lack of leverage which the user has when his hands are placed upon grip 28. In this regard, proper grip placement is aided by grip-placement indicia 56, 56' upon shaft 26 below handle 28 which indicate the location of the thumbs when the grip is proper. Although the restorative force provided by spring 48 is relatively minimal, its application at the grip-remote end 42 of shaft 26 is very effective. Only if the user applies sufficient ball-striking force, through isometric exertion, of a predetermined magnitude sufficient for development of the user's musculature will plunger 44 move outwardly from the body of fixture 22 to provide dynamic indication to the user.

It will accordingly be understood that the new exerciser is truly of an isometric type in that the user will not continually undergo substantial movement during exercise but will instead have the body and arms positioned, during the exertive effort, precisely as if the golf ball were being struck, thereby to maximize the stimulation and development of that musculature which comes into play and is necessary at this precise and critical moment of the golf swing. Only if the exertion is adequate for the development, i.e., the stimulation and growth, of this musculature will the user be able to observe the slight, almost incremental, outward movement of plunger 44 and, thus, know that the effort has been sufficiently great. Typically, it is to be expected that a golfer who has not been making routine use of the new exerciser initially will be unable to achieve such dynamic indication and may have to undergo a period of isometric exercise with the new apparatus over a period of days before attaining the requisite strength.

To provide the realistic ability to freely move the grip end of shaft 26 in multiple degrees of freedom, the outer end of plunger 44 is provided with a head 58 which, merely for purposes of illustration is of ball-like character. Fitting 30 defines appropriately a recess for head 58, being held in place by a set screw 60 or equivalent means. This arrangement provides the golfer with a realistic club "feel" which allows him to freely move the grip around in a limbering-up type of motion prior to the exertive effort of exercise.

To prevent damage to fine floor finishes and to provide a more positive slip-resistant character, platform 12 may be provided with a resilient bottom surface coating or layer 62 along portions or the entirety of its undersurface. Similarly, a layer 64 of such material beneath the platform-remote end of member 16 is desirable.

For utilizing the new exerciser, the user may quickly assemble the unit by slipping member 16 into its track or channel 20 and tighten fixture 22 at the desired location upon member 16. Then, the user steps upon the foot placement indicia 14, 14', it being noted that the left heel is closely proximate channel 20 and with the left foot pointed outwardly as is desirable. The user then grips member 26 by proper placement of the hands about grip 28, being sure to locate the thumbs according to the placement indicia 56, 56'. In this way, the user now stands in perfect alignment and immediately in front of the location of what would be a golf ball at the end of shaft 26. The user is now ready to press forwardly, i.e., in the direction of axis 46, corresponding to the assumed movement of a golf ball upon impact and, using all of the muscles of the hands, arms, legs and stomach will attempt to pull plunger 44 from fixture 22 against the resistance of spring 48. Only when all muscles so used are properly exerted to achieve a predetermined minimum dynamic force of a ball-striking character will there be any displacement of plunger 44. Therefore, by isometric continued application of such sources over different exercise periods, but to the minimum level required for muscle development (as visually indicated by extension of plunger 44 and tactilely perceived by the user upon occurrence) the user will exercise all muscles which normally are employed in the golf swing; and through such systematic use will create more power for the golf swing, resulting in drives which are straighter and of greater distance.

In view of the foregoing, it is seen that the several objects of the invention are achieved and other advantageous results are obtained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpeted as illustrative rather than limiting.

What is claimed is:

1. A golfer's exercising apparatus for isometric development of a golfer's musculature, comprising a golf club-simulative member including a shaft grippable at its upper end in the manner of a golf club by the user, means for affixing the grip-remote end of said club-simulative member at a position in front of the user for presenting said shaft to the user in an orientation simulative of the position of a golf club at the moment of impact of a golf club with a ball, and dynamic indicator means, associated with said affixing means, for providing resilient interconnection of said grip-remote end with said affixing means for dynamically, resiliently resisting movement of the grip-remote end laterally away from an initial position defined by said affixing means and for permitting such movement from said initial position only upon development by the user of a predetermined minimum dynamic force of a ball-striking character, said movement providing the user with dynamic indication of a ball-striking force exerted by the user of magnitude sufficient for development of the user's musculature, said affixing means comprising a platform for the user to stand upon, means for locating the feet of the user at a predetermined location upon said platform, and an elongated member extending forwardly from said platform for attachment of the grip-remote end of said shaft, said affixing means including an attachment fixture configured for being selectively, adjustably positioned upon said elongated member for location of the grip-remote end of said shaft at a preselected distance in front of the user, said elongated member constituting an elongated guide for said attachment fixture with said attachment fixture being slidable along said guide, said attachment fixture including adjustable clamp means for permitting selective clamping of said attachment fixture at a predetermined location along the length of said elongated guide dependent upon the personal preference and measurements of the user, said resilient interconnection means comprising a plunger reciprocal laterally in and out of said attachment fixture along an axis aligned with the normal direction of ball movement when struck by the golf club and means resiliently biasing said plunger toward a position within said attachment fixture and opposite from the normal direction of ball movement.

2. Exercising apparatus according to claim 1 and further characterized by said resilient biasing means comprising a coil spring operatively associated with said plunger, and means for selectively adjusting the tension of said coil spring.

3. Exercising apparatus according to claim 2 and further characterized by pivotal interconnection means for pivotally interconnecting of the grip-remote end of said shaft with said plunger for providing pivotal movement of said grip-remote end relative to said affixing means in multiple degrees of freedom.

4. Exercising apparatus according to claim 1 and further characterized by said platform comprising a fixture for slidably receiving said elongated member to permit interconnection to, and detachment from said platform of said elongated member.

5. Exercising apparatus according to claim 1 and further characterized by said club simulative member comprising a grip and grip-placement indicia associated with said grip for indicating to the user proper placement of the user's hands relative to said grip, said platform including foot-placement indicia for proper placement of the user's feet relative to the grip-remote end of said shaft.

6. Exercising apparatus according to claim 5 and further characterized by said platform being of generally rectangular configuration, said affixing means comprising an elongated member extending forwardly from said platform between the user's feet when placed according to said foot placement indicia, and an attachment fixture carried by said elongated member remote from said platform, said fixture being pivotally interconnected with the grip-remote end of said shaft.

* * * * *